252-97 AU 157 EX
9/30/86 XR 4,614,606

United States Patent [19]
Machin et al.

[11] Patent Number: 4,614,606
[45] Date of Patent: Sep. 30, 1986

[54] LIQUID SCOURING COMPOSITIONS

[75] Inventors: David Machin, South Wirral; John F. Helliwell, Wirral, both of Great Britain

[73] Assignee: Lever Brothers Company, New York, N.Y.

[21] Appl. No.: 666,393

[22] Filed: Oct. 30, 1984

[30] Foreign Application Priority Data

Oct. 31, 1983 [GB] United Kingdom ..... 8328991

[51] Int. Cl.[4] ..... C11D 3/14; C11D 9/20
[52] U.S. Cl. ..... 252/116; 252/97; 252/109; 252/113; 252/121; 252/110; 252/131; 252/531; 252/532; 252/535; 252/540; 252/526; 252/528; 252/174.16; 252/DIG. 14
[58] Field of Search ..... 252/110, 112, 113, 116, 252/119, 120, 128, 131, 132, 528, 102, DIG. 14, 174.16, DIG. 16, 109

[56] References Cited

U.S. PATENT DOCUMENTS

| | | | |
|---|---|---|---|
| 3,281,367 | 10/1966 | Jones et al. | 252/112 |
| 3,314,891 | 4/1967 | Schmolka et al. | 252/135 |
| 3,629,127 | 12/1971 | Palmer et al. | 252/55 |
| 3,862,049 | 1/1975 | McGrath et al. | 252/108 |
| 4,153,569 | 5/1979 | van den Brom | 252/109 |
| 4,244,840 | 1/1981 | Straw | 252/540 |
| 4,284,532 | 8/1981 | Leikhim et al. | 252/528 |
| 4,302,347 | 11/1981 | Straw et al. | 252/116 |
| 4,396,525 | 8/1983 | Rubin et al. | 252/174.25 |
| 4,397,755 | 8/1983 | Brierly et al. | 252/113 |
| 4,446,043 | 5/1984 | Tai | 252/105 |
| 4,465,613 | 8/1984 | Carter | 252/174.16 |

FOREIGN PATENT DOCUMENTS

| | | |
|---|---|---|
| 50887 | 5/1982 | European Pat. Off. . |
| 80221 | 6/1983 | European Pat. Off. . |
| 1167597 | 10/1969 | United Kingdom . |
| 1181607 | 2/1970 | United Kingdom . |
| 1262280 | 2/1972 | United Kingdom . |
| 1303810 | 1/1973 | United Kingdom . |
| 1308190 | 2/1973 | United Kingdom . |
| 1345119 | 1/1974 | United Kingdom . |
| 1418671 | 12/1975 | United Kingdom . |
| 1581433 | 12/1980 | United Kingdom . |
| 2125428 | 3/1984 | United Kingdom . |
| 2126600 | 3/1984 | United Kingdom . |

*Primary Examiner*—Prince E. Willis
*Attorney, Agent, or Firm*—James J. Farrell

[57] ABSTRACT

The invention pertains to liquid scouring compositions comprising by weight of the total composition, from 1 to 65% of a particulate abrasive material, and from 35 to 99% of an aqueous liquid suspending medium, which comprises, by weight of the medium:

(a) from 3 to 15% of a synthetic anionic detergent-active material;
(b) from 1 to 12% of a zwitterionic and/or alkoxylated nonionic detergent-active material;
(c) a foam-regulating system comprising:
  1. from 0.5 to 7% of tripolyphosphate electrolyte; and
  2. from 0.05 to 8% of a $Ca^{2+}$-dependent foam-depressing agent;
  the weight ratio between component (1) and component (2) being within the range of from 1:1 to 8:1; and
(d) optionally, up to 20% by weight of further electrolytes.

Compositions according to the invention show good physical and chemical stability and improved foam/-rinse properties.

9 Claims, No Drawings

LIQUID SCOURING COMPOSITIONS

The present invention relates to scouring compositions and more in particular to improved scouring cleaning compositions comprising particulate abrasive material suspended in a liquid aqueous medium.

Liquid scouring cleaning compositions are well-known in the art. They are extensively used in the ordinary household cleaning of hard surfaces providing convenient means for the elimination of stubborn soils, greases, burnt materials and stains which are not easily or completely removed by ordinary abrasive-free detergent products.

By far the majority of prior art disclosures in the liquid scourer field are focused on improvements in the physical stability and suspending properties of the liquid medium. Exemplary disclosures are e.g. the UK Patent Specifications Nos. 1,167,597, 1,181,607, 1,262,280, 1,303,810, 1,308,190 and 1,418,671. Other disclosures are concerned with the stability of the suspending medium under high extensional shearing which may occur during processing and handling of the product, such as the EP Patent Specifications Nos. 0 050 887 and 0080 221.

Although, of course, stability during processing and storage is of the utmost importance, consumer acceptance is also greatly influenced by the physical behaviour and appearance of the product under actual application. Products should not only provide powerful, but non-scratching cleaning action, they should also display properties such as a rich foaming behaviour, soft feel, easy rinseability etc. to gain the consumer's preference.

Until now the combination of a rich foaming behaviour at the beginning of and during the cleaning act and easy rinseability of the foam after the cleaning operation has proven difficult to achieve since the properties are in general mutually excluding. Foam boosting agents affect easy foam rinseability in a negative way, whereas rinseability improving agents do vice versa.

It is, therefore, an object of the present invention to provide liquid scouring compositions, which combine the advantages of rich initial foaming and easy foam rinsability. It is a further object of the present invention to provide such compositions which are physically stable for prolonged periods of time and which are stable under high extensional shearing during processing and handling.

It has now been found that liquid scouring compositions of the desired type can be realized by using a suspending medium which comprises an active mixture of a synthetic anionic detergent, and a zwitterionic and/or alkoxylated nonionic detergent, the composition further comprising a $Ca^{2+}$-dependent foam-regulating system consisting of a foam-depressing agent and a tripoly phosphate electrolyte, the weight ratio between the two foam-regulating agents lying within the range as described below.

Accordingly, in its broadest aspects the present invention provides a stable liquid scouring composition with improved foam/rinse properties comprising, by weight of the total composition, from 1% to 65% of a particulate abrasive material, and from 35% to 99% of an aqueous liquid suspending medium which comprises, by weight of the medium:

(a) from 3% to 15% of a synthetic anionic detergent-active material, (b) from 1% to 12% of a zwitterionic and/or alkoxylated nonionic detergent-active material, (c) a foam-regulating system, comprising:

(1) from 0.5 to 7% of tripolyphosphate electrolyte; and (2) from 0.05 to 8% of a $Ca^{2+}$-dependent foam-depressing agent; the weight ratio between component (1) and component (2) being within the range of from 1:1 to 8:1; and (d) optionally, up to 20% by weight of further electrolytes.

The proportions of the various components which will result in the requisite properties are to a certain degree mutually dependent. Accordingly for a given proportion of one component the appropriate proportions of the others can be found within the specified ratios and ranges by ordinary experimental routine.

The abrasive material

Suitable for use as the abrasive material are both natural and synthetic abrasives, for example dolomite, precipitated calcium carbonate (aragonite), feldspar, alumina, silica abrasives, such as quartz and quartzite; and preferably an abrasive material is used with a hardness on Moh's scale of from 1 to 4. Particularly suitable is calcite, for instance lime stone, chalk or marble, such as those forms of calcite referred to in UK Pat. No. 1,345,119. It may be advantageous to use abrasive material having a specific particle size distribution in which the, for example, lower and/or higher end of the particle size spectrum has been removed, such as described in the UK Patent Specification No. 1,581,,433 and the unpublished UK patent application No. 832226. It may also be advantageous to include abrasive material of the agglomerated type such as described in the unpublished UK patent application No. 8319441. The abrasive material is generally present in an amount of from 1% to 65 wt. % of of the total composition, preferably of from 10 to 55% by weight, whereas the highest abrasive cleaning efficiency is achieved with an amount of from 30% to 55%.

The aqueous liquid suspending system

The aqueous suspending system comprises two essential detergent-active ingredients: a synthetic anionic detergent-active material and a zwitterionic and/or alkoxylated nonionic detergent-active material.

Suitable synthetic anionic detergent materials are alkali metal or alkanol amine salts of $C_{12}$–$C_{18}$ branched or straight chain alkylaryl sulphonates, of $C_{12}$–$C_{18}$ paraffin sulphonates, of $C_8$–$C_{12}$ branched or straight chain alkyl sulphates and of $C_{10}$–$C_{18}$ alkyl $(EO)_{1-10}$ sulphates.

In general the amount of synthetic anionic surfactant will vary between 3% and 15% by weight of the aqueous medium. Preferably the aqueous medium preferably comprises 4% to 10% by weight of the synthetic anionic detergent.

The aqueous medium further comprises an alkoxylated nonionic or zwitterionic detergent material in an amount of 1% to 12% by weight of the medium, preferably from 2% to 7%. Suitable examples of alkoxylated nonionic detergent materials include the condensation products of ethylene-and/or propylene-oxide with linear primary or secondary $C_8$–$C_{18}$ alcohols, and with $C_9$–$C_{18}$ alkyl phenols. Suitable zwitterionic detergents are trialkyl amine oxides having one long alkyl chain ($C_8$–$C_{18}$) and two short alkyl chains ($C_1$–$C_4$); betaines and sulphobetaines.

The foam regulating system

The foam regulating system which provides the advantageous properties of high initial foaming and easy foam rinsability comprises a combination of a $Ca^{2+}$-dependent foam-depressing agent and a tripoly phosphate electrolyte.

The foam depressing agent should be a $Ca^{2+}$-dependent one, i.e., its defoaming action should be dependent on the presence of free $Ca^{2+}$-ions, which may be due to the use of hard water or to the inclusion of an abrasive material such as calcite. Suitable $Ca^{2+}$-dependent foam-depressing agents include the alkali metal salts of $C_{10}$–$C_{24}$ fatty acid soaps and compounds of the phosphate ester type, such as the alkyl- and alkyletherphosphates. The fatty acid soaps are preferably derived from a fatty acid blend, the major proportion of which contains saturated alkyl chains having no less than 16 carbon atoms, such as the soap blends described in the U.S. Pat. No. 3,862,049.

The amount of foam depressing agent in the foam-regulating system which effectively increases the foam-rinsability, is dependent on the other compositional parameters, and in particular on the amount of synthetic anionic detergent-active material.

In general the foam depressing agent is included within the range of from 0.05% to 8% by weight of the aqueous medium. Preferably, the weight ratio between the foam depressing agent and the synthetic anionic detergent-active material lies within the range of from 1:20 to 1:4.

The second essential component in the foam-regulating system is a tripoly phosphate electrolyte, in particular the alkali metal salts thereof. The amount of tripoly phosphate electrolyte in general does not exceed 7% by weight of the aqueous medium. To obtain the foam-regulating effect of the present invention, the weight ratio of the foam-depressing agent to the tripoly phosphate electrolyte must lie within the range of from 1:1 to 1:8. Preferably this ratio ranges from 1:1 to 1:6 and most preferably from 1:2 to 1:4. Without being bound to any theory it is believed that due to the removal of $Ca^{2+}$-ions by the $Ca^{2+}$-sequestering builder the effectiveness of the foam-depressing agent which is dependent on the formation of $Ca^{2+}$-salts, is greatly reduced at the beginning of the cleaning act, whereas on further dilution with water at the rinsing stage the builder concentration becomes too low to continue to remove $Ca^{2+}$-ions effectively, so that at that stage the anti-foam can be formed and easy foam-rinsability is established.

Optionally, up to 20% of further electrolytes can be included. These electrolytes can be simple salts such as alkali metal chloride, -nitrate, -silicate, -borate, -citrate, -orthophosphate, nitrilotriacetate or mixtures thereof. The alkalimetal is preferably sodium or potassium. Preferably a sodium or potassium carbonate, -bicarbonate or -sesquicarbonate is used. The amount of these electrolytes preferably varies between 1% and 15% by weight of the aqueous medium.

The total amount of electrolytes in the aqueous medium lies within the range of 0.5 to 25% by weight of the aqueous medium. The total amount of condensed phosphate electrolytes should not exceed 7% by weight of the aqueous medium.

The compositions may furthermore comprise other ingredients which are useful in liquid scouring compositions, such as perfumes, colouring agents, solvents, fluorescers, hydrotropes, soil-suspending agents, clays, oxygen or chlorine liberating bleaches, enzymes, opacifiers, germicides, humectants, etc.

The invention will now be further illustrated by way of example, all percentages being given by weight of the total composition.

The foam-rinse properties in the following example compositions are characterized by way of two parameters, viz., (a) the initial foam volume ($V_o$) and (b) the number of rinses needed to reduce the foam volume to half ($n[\frac{1}{2}]$).

(a) In a 250 ml graduated separating funnel 5 grams of sample product are mixed with water to a total volume of 50 ml. The mixture is shaken vigorously for 10 seconds, after which the foam volume ($V_o$) is measured. An initial foam volume which exceeds 80% of the funnel volume is considered satisfactory.

(b) Immediately after the procedure described under (a) the aqueous layer is run off without leaving the foam to drain. 50 ml of fresh water are added to the funnel and the foam volume is remeasured after vigorous shaking for 10 seconds. This procedure is repeated until no foam is left.

The rinsability is now characterized by the number of rinses ($n[\frac{1}{2}]$) needed to reduce the foam volume to half its initial value. In practice rinsing tends to be considered inconvenient when $n[\frac{1}{2}]$ exceeds 3.

For reasons of comparison a number of liquid scouring compositions without the foam-regulating system according to the present invention are listed in Table I. The conventional compositions in Table I clearly indicate the generally mutual exclusivity of rich foaming and good foam rinsability.

In Table II examples are given showing the beneficial effect of inclusion of the foam-regulating system according to the present invention.

TABLE I

| Ingredients | I | II | III | IV | V | VI | VII | VIII | IX | X | XI |
|---|---|---|---|---|---|---|---|---|---|---|---|
| Sodium dodecyl benzene-sulphonate | 3.5 | 2.5 | 3.0 | 3.2 | 3.2 | 3.25 | 3.0 | 3.75 | — | 3.38 | 3.0 |
| Sec. alkane sulphonate ($C_{14}$–$C_{17}$) | — | — | — | — | — | — | — | — | 2.16 | — | — |
| Mono coconut dimethyl amineoxide | 1.5 | 2.5 | — | — | — | — | 2.0 | — | 1.73 | — | — |
| Ethoxylated alcohol ($C_9$–$C_{11}$, $EO_6$) | — | — | 2.0 | 0.9 | 0.9 | 1.75 | — | 1.25 | | 1.25 | 1.25 |
| Coconut monoethanol amide | — | — | — | 0.9 | 0.9 | — | — | — | — | — | — |
| Sodium soap(1) | — | — | — | — | — | — | 1.0 | — | — | 0.38 | 0.75 |
| Sodium tripolyphosphate | — | — | 1.25 | 2.3 | — | 1.25 | — | — | — | — | — |
| Sodium citrate | 1.5 | 1.5 | — | — | — | — | — | — | — | — | — |
| Sodium carbonate | — | — | 1.25 | — | 2.3 | 1.25 | — | 2.5 | 4.0 | 2.50 | 5.50 |
| Sodium bicarbonate | — | — | — | — | — | — | 1.0 | — | — | 0.75 | — |
| Magnesium hydroxide | — | — | — | — | — | — | — | — | 0.3 | — | — |
| Sodium hypochlorite | — | — | — | — | — | — | — | — | 10.5 | — | — |

TABLE I-continued

| Ingredients | I | II | III | IV | V | VI | VII | VIII | IX | X | XI |
|---|---|---|---|---|---|---|---|---|---|---|---|
| (15% av. $Cl_2$) | | | | | | | | | | | |
| Calcite abrasive | 50 | 50 | 50 | 50 | 50 | 50 | 50 | 50 | 50 | 50 | 50 |
| Water hardness(2) | 24 | 24 | 24 | 24 | 24 | 24 | 24 | 24 | 24 | 24 | 24 |
| $V_o$ in % of funnel volume | 90 | 100 | 100 | 100 | 100 | 100 | 20 | 100 | 100 | 55 | 50 |
| n[$\frac{1}{2}$] | 4.8 | 6.0 | 3.7 | 4.5 | 5.7 | 4.7 | 1.5 | 5.2 | 4.8 | 1.7 | 1.5 |

(1)In all examples the soap composition consisted of:
17% sat. soaps having less than 15 carbon atoms
23% sat. soaps having more than 15 carbon atoms
60% unsat. soaps having more than 15 carbon atoms
(2)water hardness as measured in French degrees of hardness.

TABLE II

| Ingredients | I | II | III | IV | V | VI | VII | VIII | IX |
|---|---|---|---|---|---|---|---|---|---|
| Sodium dodecyl benzene-sulphonate | 3.56 | 3.56 | 3.38 | 3.38 | 3.0 | 3.0 | 3.0 | — | 3.25 |
| Sec. alkane sulphonate ($C_{14}$–$C_{17}$) | — | — | — | — | — | — | — | 1.73 | — |
| Ethoxylated alcohol ($C_9$–$C_{11}$, $EO_6$) | 1.25 | 1.25 | 1.25 | 1.25 | 1.25 | 1.25 | 1.25 | — | 1.25 |
| Monococonut dimethyl amine oxide | — | — | — | — | — | — | — | 1.73 | — |
| Sodium soap | 0.19 | 0.19 | 0.38 | 0.38 | 0.75 | 0.75 | 0.75 | 0.44 | 0.45 |
| Sodium tripolyphosphate | 0.38 | 0.75 | 0.75 | 1.50 | 0.75 | 1.50 | 3.0 | 1.73 | 1.00 |
| Sodium carbonate | 2.50 | 2.50 | 2.50 | 2.50 | 2.50 | 2.50 | 2.50 | 4.00 | 1.60 |
| Sodium bicarbonate | — | — | — | — | — | — | — | — | 0.40 |
| Sodium citrate | — | — | — | — | — | — | — | — | — |
| Sodium pyrophosphate | — | — | — | — | — | — | — | — | — |
| Magnesium hydroxide | — | — | — | — | — | — | — | 0.30 | — |
| Sodium hypochlorite (15% av. $Cl_2$) | — | — | — | — | — | — | — | 11.50 | — |
| Calcite | 50 | 50 | 50 | 50 | 50 | 50 | 50 | 50 | 50 |
| Water hardness | 24 | 24 | 24 | 24 | 24 | 24 | 24 | 24 | 24 |
| $V_o$ in % of funnel volume | 95 | 100 | 85 | 100 | 95 | 90 | 90 | 100 | 90 |
| n[$\frac{1}{2}$] | 2.6 | 2.7 | 2.2 | 1.9 | 1.9 | 1.5 | 1.5 | 2.7 | 2.2 |

We claim:

1. A liquid scouring composition consisting essentially of, by weight of the total composition, from 1 to 65% of a particulate abrasive material, and from 35 to 99% of an aqueous liquid suspending medium which consists essentially of, by weight of the medium:
   (a) from 3 to 15% of a synthetic anionic detergent-active material;
   (b) from 1 to 12% of a detergent-active material selected from the group consisting of zwitterionic and alkoxylated non-ionic detergent-active materials;
   (c) a foam-regulating system consisting essentially of;
      (1) from 0.5 to 7% of a tripolyphosphate electrolyte; and,
      (2) from 0.05 to 8% of a calcium$^{2+}$-dependent foam-depressing agent selected from group consisting of alkali metal salts of $C_{10}$–$C_{24}$ fatty acid soaps and phosphate esters; the weight ratio of component (2) to component (1) being from 1:2 to 1:4; and
      (3) from 0 to 20% further electrolytes.

2. A composition according to claim 1 wherein the $Ca^{2+}$ dependent foam-depressing agent is a fatty acid soap derived from a fatty acid blend the major proportion of which contains saturated alkyl chains having no less than 16 carbon atoms.

3. A composition according to claim 1 wherein the weight ratio between the $Ca^{2+}$-dependent foam-depressing agent and the synthetic anionic detergent-active material lies within the range of from 1:20 to 1:4.

4. A composition according to claim 1 wherein it comprises, by weight of the aqueous medium from 4 to 10% of the synthetic anionic detergent-active material.

5. A composition according to claim 1 wherein it comprises, by weight of the aqueous medium from 2 to 7% of the zwitterionic and/or alkoxylated nonionic detergent-active material.

6. A composition according to claim 1 wherein it comprises, by weight of the total composition, from 35 to 55% of the abrasive material.

7. A composition according to claim 1 wherein the abrasive material is calcite.

8. A composition according to claim 1 wherein it comprises, by weight of the aqueous medium from 1 to 15% of the further electrolytes.

9. A composition according to claim 1 wherein the further electrolytes are selected from the group consisting of alkalimetalcarbonates, -bicarbonates and -sesquicarbonates.

* * * * *